United States Patent [19]

Hatsuse et al.

[11] Patent Number: 4,492,479

[45] Date of Patent: Jan. 8, 1985

[54] SMALL ELECTRONIC TIMERS

[75] Inventors: Toshikazu Hatsuse, Tanashi; Kazunari Kume, Tokorozawa, both of Japan

[73] Assignee: Citizen Watch Co., Ltd., Tokyo, Japan

[21] Appl. No.: 489,266

[22] Filed: Apr. 27, 1983

[30] Foreign Application Priority Data

May 7, 1982 [JP] Japan ..... 57-76181
May 14, 1982 [JP] Japan ..... 57-70266[U]

[51] Int. Cl.[3] ..... G04F 8/00; G04C 21/16

[52] U.S. Cl. ..... 368/109; 368/250; 368/276

[58] Field of Search ..... 368/10, 69, 70, 72–74, 368/155–156, 185–187, 250–251, 276, 107–113

[56] References Cited

U.S. PATENT DOCUMENTS

| | | | |
|---|---|---|---|
| 3,817,019 | 6/1974 | Fowler | 368/73 |
| 3,961,473 | 6/1976 | Hung | 368/96 |
| 4,079,583 | 3/1978 | Larsen | 368/108 |
| 4,196,583 | 4/1980 | Komaki | 368/73 |
| 4,209,969 | 7/1980 | Kitai et al. | 568/250 |
| 4,218,871 | 8/1980 | Moritani et al. | 368/109 |
| 4,303,995 | 12/1981 | Aizawa | 368/29 |
| 4,382,687 | 5/1983 | Lemelson | 368/278 |

*Primary Examiner*—Vit W. Miska
*Attorney, Agent, or Firm*—Koda and Androlia

[57] ABSTRACT

A small electronic timer comprises a circuit arrangement including a time unit pulse generating circuit for generating a time unit pulse, a time counter for counting the time unit pulse, a data memory circuit, a coincidence detecting circuit for comparing data stored in the data memory circuit and data of the time counter and producing a coincidence signal, and a control circuit operated by the coincidence signal; a sound emitting means driven by the control circuit; a time setting means for feeding a set time to the data memory circuit; and a first housing and a second housing for accommodating the circuit arrangement, sound emitting means and time setting means. The first and second housings permits their relative position to be changed, and by changing it, the time setting means is operated and the timer is set.

10 Claims, 9 Drawing Figures

SMALL ELECTRONIC TIMERS

BACKGROUND OF THE INVENTION

1. Field of the Invention

This invention relates to a small electronic timer, and more particularly to an electronic timer which is easy in setting operation for ordinary use.

2. Description of the Prior Art

In general, the conventional timers of this kind incorporate an escapement using a mainspring as the power source, and in many cases, desired time is set by turning a dial directly connected to the winding-shaft of the mainspring to wind up the mainspring. Recently, some electronic watches also provide a timer function by the digital setting mode.

There are various applications for these timers, each of which sounds an alarm to attract the user's attention when the set time has been reached. For ordinary use, the first condition of serviceable timers is easy setting operations. In this respect, the mainspring winding type timers mentioned above are preferable. But they have drawbacks to smallness. On the other hand, the digital setting type timers have the drawback of the complexity of the setting operations.

SUMMARY OF THE INVENTION

In view of the conventional drawbacks, this invention is to provide a small electronit timer which is easy in setting operation. In a daily life except for some special cases, the time unit required for a timer is one minute or five minutes. To measure time in seconds or hours, it would be better to use other means. For example, to measure time in seconds, it may be replaced by reading the second hand of an analog timepiece, while to measure time in hours, it may be replaced by keeping the time interval in mind from the time display showing the hour and minute or by setting an alarm. Should an accuracy to the second be required for time measurement in hours, it would be a rare case apart from the daily life.

Therefore, one of the objects of the invention is to provide an electronic timer which is set by the one minute or the five minutes, and easy in setting operation.

Further, another object of the invention is to provide an electronic timer having a time setting means which permits time setting to be accomplished perceively and easily.

According to the subject matter of the invention, there is provided a small electronic timer comprising: (1) a circuit arrangement including; (a) a standard frequency oscillator, (b) a frequency divider, (c) a time unit pulse generating circuit for generating a time unit pulse in response to an output signal of said frequency divider, (d) a time counter for counting said time unit pulse, (e) a data memory circuit, (f) a coincidence detecting circuit for comparing data stored in said data memory circuit and data of said time counter and producing a coincidence signal, and (g) a control circuit operated by said coincidence signal, (2) a battery for supplying power to said circuit arrangement; (3) a sound emitting means driven by said control circuit; (4) a time setting means for feeding a set time to said data memory circuit; and (5) a first housing and a second housing for accommodating said circuit arrangement, battery, sound emitting means and time setting means, said first and second housings permitting their relative position to be changed; (6) whereby, by changing the relative position of said first and second housings, said time setting means is operated and said timer is set.

DESCRIPTION OF THE PREFERRED EMBODIMENTS

Figure 1:
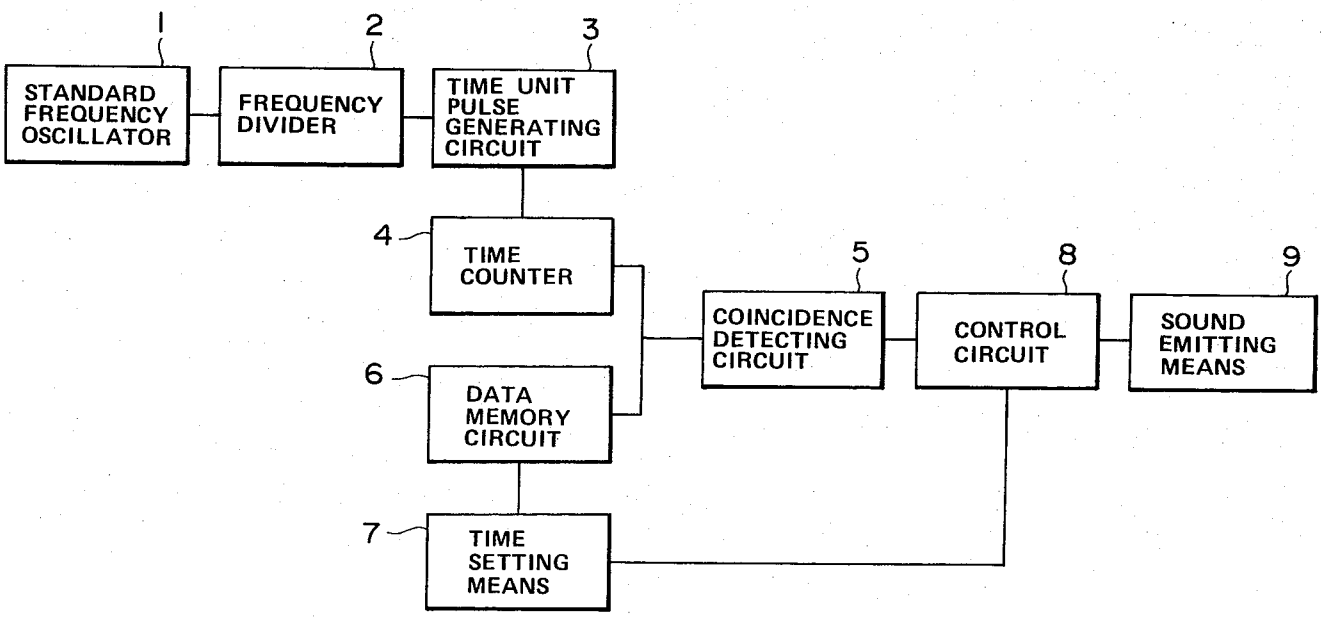
FIG. 1 is a block diagram illustrating a general system of the invention.

FIG. 1 is a block diagram illustrating the general system of an electronic timer of the invention, which includes a standard frequency oscillator 1 (in this embodiment, quartz is used, but needless to say, a CR oscillator circuit can be used); a frequency divider 2; a time unit pulse generating circuit 3; a time counter 4; a time setting means 7; a data memory circuit 6 for storing data from the time setting means 7; a coincidence detecting circuit 5 for comparing data of the time counter 4 and data of the data memory circuit 6 and producing a coincidence signal; a control circuit 8 for resetting the frequency divider 2 and the time unit pulse generating circuit 3; and a sound emitting means 9, the control circuit 8 shaping the waveform of the input signal to the sound emitting means 9.

Figure 2:
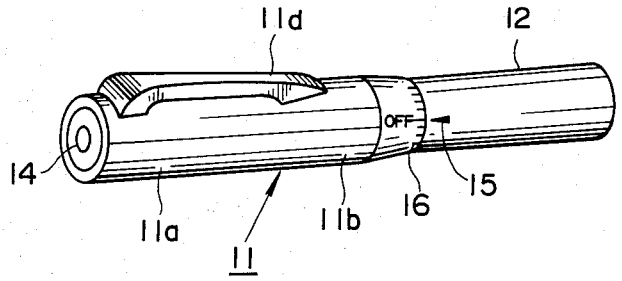
FIG. 2 is an exterior view of a first embodiment of the invention.

FIG. 2 is an exterior view of a first embodiment of the electronic timer of the invention, which is of a pen form from the viewpoint of the user's convenience of wearing and carrying and which includes an outer body 11, an inner body 12 and a clip 11*d*. The outer body 11 is designed for accommodating a sound emitting means at its top portion and, as shown in the figure, an opening 14 is provided for emitting the sound. The inner body 12 has an index 15 for use in time setting, and corresponding to the index 15, the outer body 11 has graduations 16 in five minutes (time unit).

Figure 4:
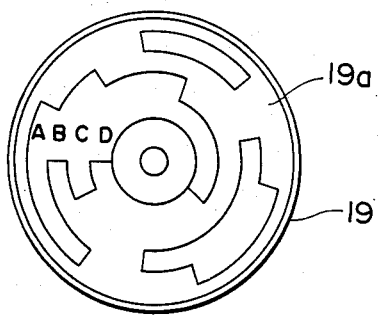
FIG. 4 is a front view of a code disk used in the first embodiment.
Figure 3:
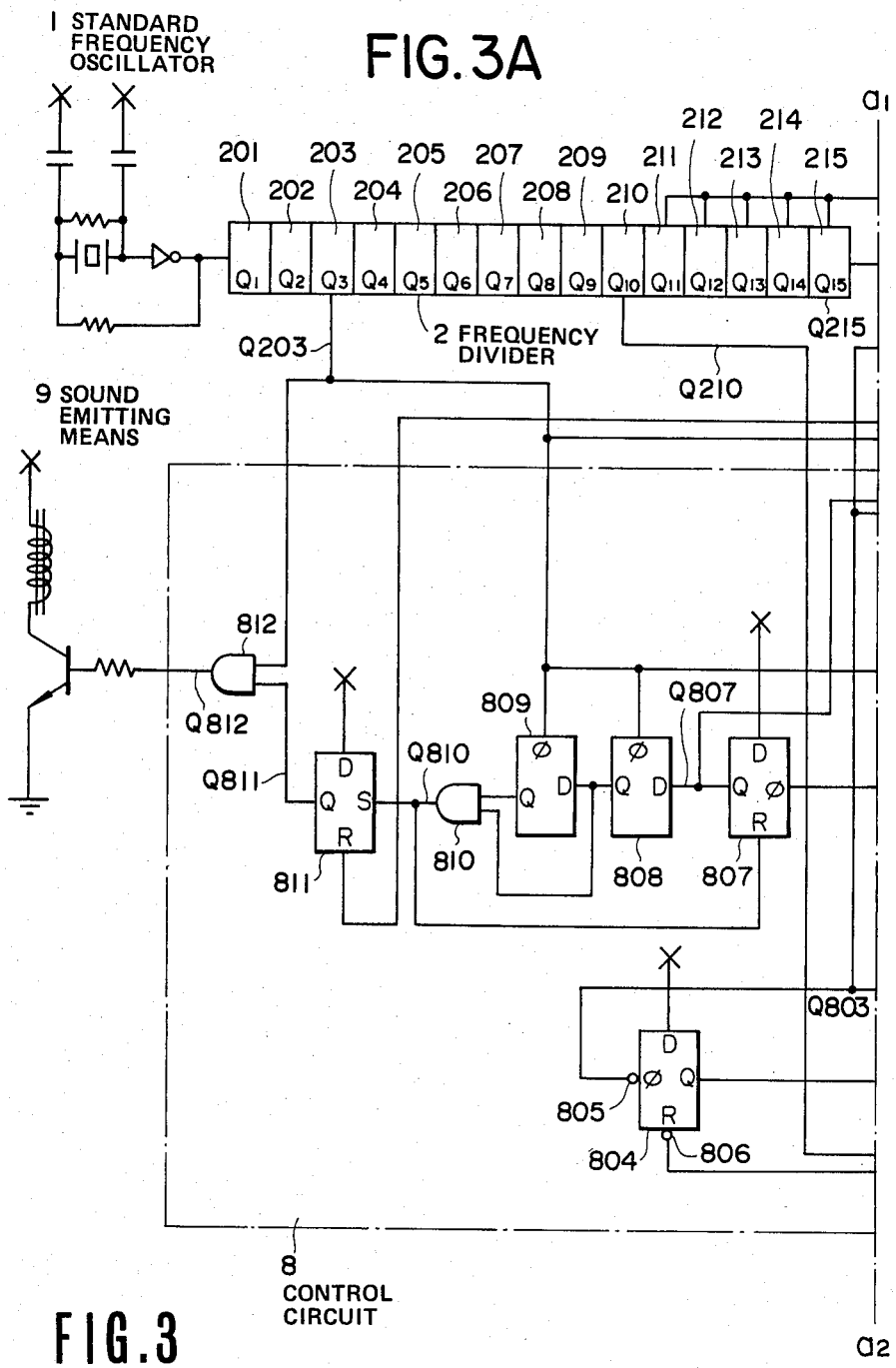
FIG. 3 (3A and 3B) is a circuit diagram of the first embodiment.
Figure 3B:
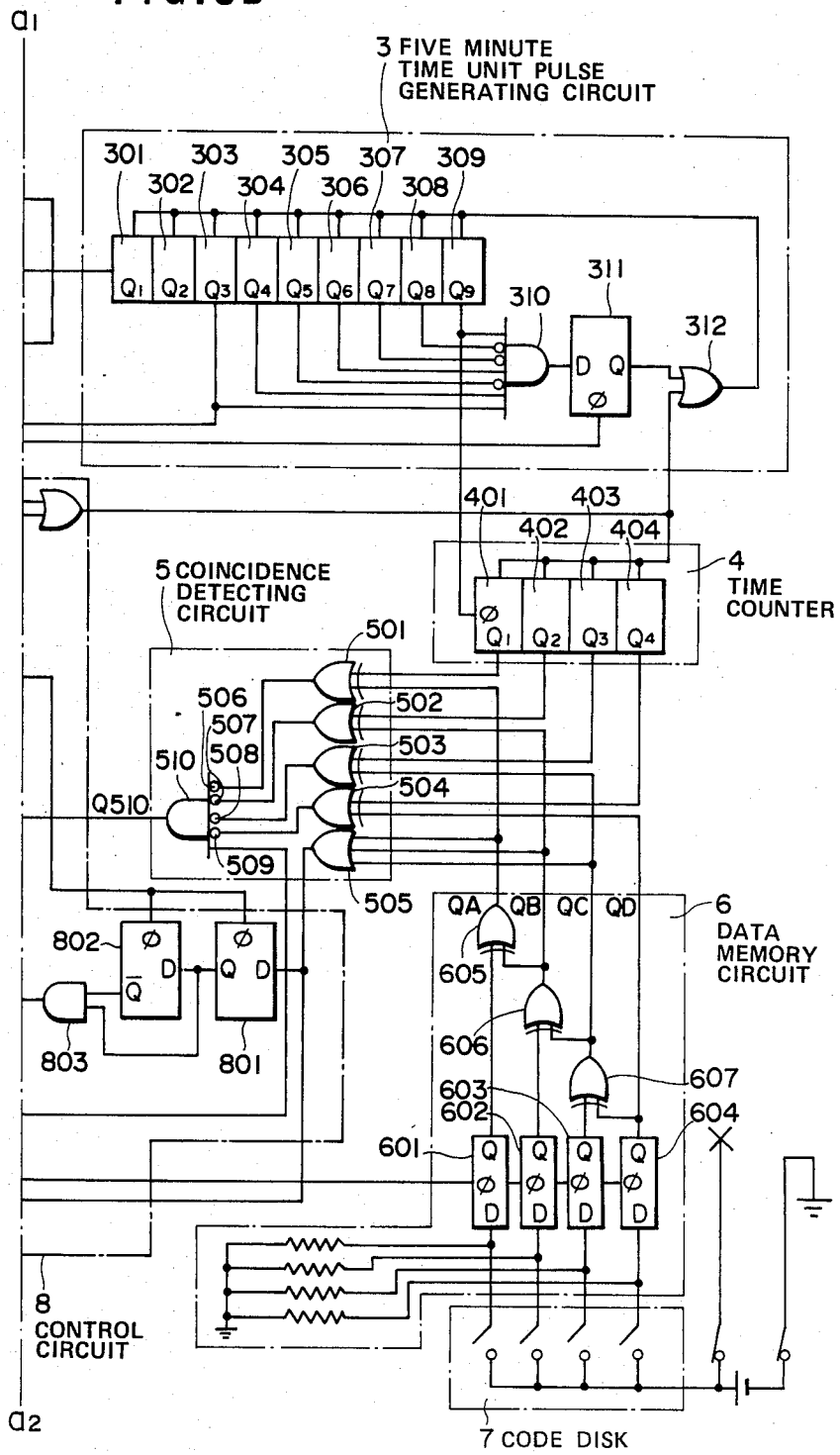
Figure 5:
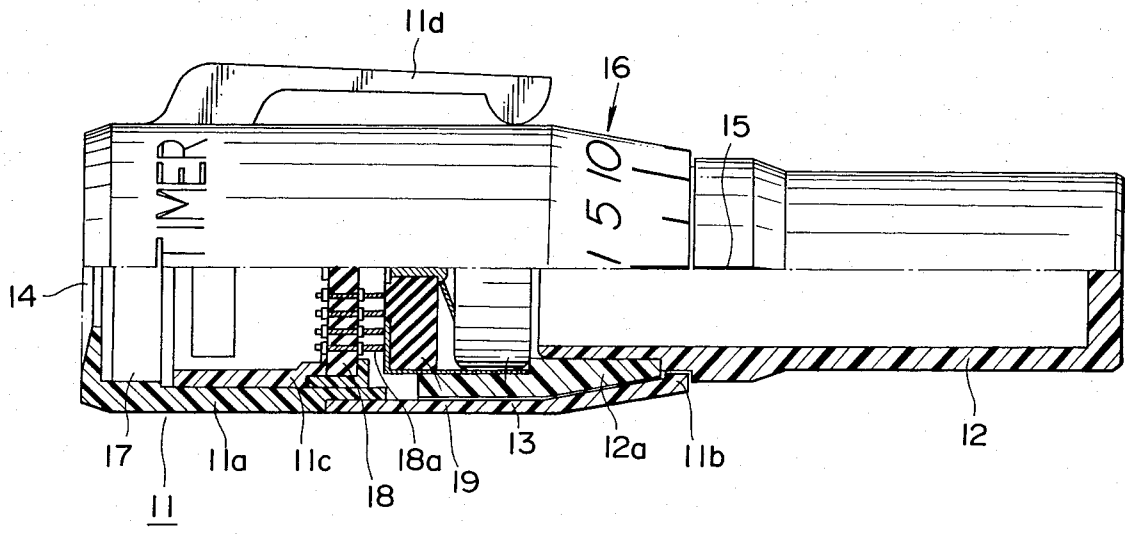
FIG. 5 is a sectional view illustrating main component parts of the first embodiment.

FIG. 3 (3A and 3B) is a circuit diagram illustrating an embodiment of a specific circuit of the electronic timer of the invention, in which a time unit pulse generating circuit 3 (a five minute time unit pulse generating circuit in this embodiment) comprises flip-flops 301 to 309, an AND gate 310, a flip-flop 311 for shaping a pulse, and an OR gate 312. The flip-flop 301 receives a 1 Hz input signal and the flip-flops 302 to 309 successively divide the signal every half. The output signals of the flip-flops 303 to 309 are received at the AND gate 310 and the flip-flop 311 shapes a pulse. Then the flip-flops 301 to 309 are reset. The signal $Q_9$ of the flip-flop 309 results in a five minute period signal. This output signal $Q_9$ is sent to a time counter 4 and is counted. That is to say, the output signals, $Q_1$, $Q_2$, $Q_3$ and $Q_4$ of the respective flip-flop 401 to 404 change their values (high or low) every five minutes. On the other hand, as shown in FIG. 4, a code disk 19 forms a gray code on a printed-circuit board. The code disk 19 is divided into thirteen sectors on its top surface to form codes (0000, 1000, 1100, 0100 . . . 0101). Four bits of A, B, C and D represent timer's set positions (setting time graduations 16 of FIG. 2). The copper foil portions 19*a* of the code disk 19 are all connected to each other, to which a positive voltage is applied. In this embodiment, if A, B, C and D take the binary code "0, 0, 0 and 0", respectively, the timer is in OFF position, "1, 0, 0 and 0", in five minute position, . . . , and "0, 1, 0 and 1", in sixty minute position, with a total of thirteen divisions. On the code disk 19, an elastic sliding contact 18*a* of FIG. 5 slides to read a code signal as potential, which is applied to the data memory circuit 6 of FIG. 3B. As shown in FIG. 3, the data memory circuit 6 includes flip-flops 601 to 604 and exclusive OR gates 605 to 607. The code signals, A, B, C and D from the code disk 7 are fed to the inputs of the flip-flops 601 to 604 and stored therein. Output signals Q each of the flip-flops 601 to 604 are inputted to exclusive OR gates 605 to 607 and converted into binary output codes $Q_A$, $Q_B$, $Q_C$ and $Q_D$. The coincidence detecting circuit 5 includes exclusive OR gates 501 to 504, an OR gate 505, inverters 506 to 509 and an AND gate 510. The exclusive OR gate 501 detects the coincidence between the output of the flip-flop 401 and the signal $Q_A$; the exclusive OR gate 502, between the output of the flip-flop 402 and the signal $Q_B$; the exclusive OR gate 503, between the output of the flip-flop 403 and the signal $Q_C$; and the exclusive OR gate 504, between the output of the flip-flop 404 and the signal $Q_D$. The OR gate 505 is an element for detecting the switch ON state and for preventing the operation of the sound emitting means when the sliding contact 18*a* of FIG. 5 is in OFF position ("0, 0, 0 and 0") on the code disk 19.

The control circuit 8 includes flip-flops 801 and 802 and an AND gate 803 (circuit for producing a pulse signal to start the time counting operation); a flip-flop 804 and inverters 805 and 806 for detecting the ON state; a flip-flop 807 for assuring the repetitive operation; flip-flops 808 and 809 and an AND gate 810 (circuit for producing a pulse signal to start the operation of the sound emitting means 9); and flip-flop 811 and an AND gate 812 (circuit for producing a pulse signal to drive the sound emitting means 9).

When the timer is set for desired time, one of the signals $Q_A$ to $Q_C$ of the data memory circuit 6 goes "high" and the output of the OR gate 505 is changed from "low" to "high" and this signal is supplied to the flip-flop 801. In response to a 4096 Hz clock pulse $Q_{203}$ of the frequency divider 2, the flip-flops 801 and 802 change the outputs $\overline{Q}$ and Q and the AND gate 803 outputs one pulse signal $Q_{803}$ with a pulse length based on 4096 Hz by the rising edge of the output signal of the OR gate 505.

The signal $Q_{803}$ resets the frequency divider 2, the time unit pulse generating circuit 3 and the time counter 4 (the time counting operation starts) and is simultaneously applied to the inverter 805. When the output of the OR gate 505 goes "high", the reset signal of the flip-flop 804 goes "low" by the inverter 806 and the flip-flop 804 reads the data "high" by the falling edge of the signal $Q_{803}$ (through the inverter 805). That is to say, the output signal Q of the flip-flop 804 goes "high", which is applied to the AND gate 510 and stands ready for detecting the coincidence.

When the set time is reached and the flip-flops 401 to 404 of the time counter 4 match the respective signals $Q_A$ to $Q_D$, all the outputs of exclusive OR gates 501 to 504 go "low" and they are supplied to the AND gate 510 through the inverters 506 to 509. Therefore, the output signal $Q_{510}$ of the AND gate 510 goes "high".

The flip-flop circuit 807 for assuring the repetitive operation, receives the signal $Q_{510}$, reads the data and makes the output signal "high". The signal $Q_{807}$ activates the pulse generating circuit comprising the flip-flops 808 and 809 and the AND gate 810, and the output signal $Q_{810}$ of the AND gate 810 is sent into the reset terminal R of the flip-flop 807. This signal $Q_{810}$ is a narrow pulse signal. The signal $Q_{807}$ resets the flip-flops 401 to 404 of the time counter 4 and the flip-flops 301 to 309 of the five minute time unit pulse generating circuit 3. As a result, the time counter 4 starts recounting.

On the other hand, the signal $Q_{810}$ is applied to the set terminal S of the flip-flop circuit 811 for forming a driving signal to the sound emitting means 9 and the data "high" is read. Also, since the reset terminal R of the flip-flop 811 is supplied with a $\frac{1}{8}$ Hz signal of the flip-flop 303, the signal of the reset terminal R of the flip-flop 811 goes "high" four seconds later and the signal $Q_{811}$ is inputted to the AND gate 812, which outputs a 4096 Hz driving signal to the sound emitting means 9 for four seconds.

FIG. 5 is a sectional view illustrating the main component parts of the electronic timer of this invention, as mentioned above, the outer body 11 has the clip 11*d* for the user's convenience of wearing and carrying and forms a cavity inside for holding most of the main component parts of the invention. In view of the case of assembly and such, the outer body 11 comprises a head portion 11*a* and a base portion 11*b* having graduations 16. The head portion 11*a* holds the sound emitting means 17 and has the sound emitting hole 14 in its top. A holder 11*c* is formed cylindrical so as to contact the internal surface of the head portion 11*a*. At one end of the holder 11*c* is fixed the circuit board 18. Electronic parts such as quartz, resistors and capacitors are arranged on the circuit board 18 and held within the holder 11*c*. The circuit board 18 is provided with the above-mentioned sliding contact 18*a* which slides on the code disk 19 for converting a set time into a coded signal, as shown in detail in FIGS. 3 and 4. On the other hand, the inner body 12 has the index 15, and the base portion 11*b*, which has the graduations 16 corresponding to the index 15, is slidably held to the inner body 12 through a holder 12*a*. The holder 12*a* accommodates a battery 13 and the code disk 19 and is held together with the inner body 12 by bonding or force fit. The code disk 19 has a pattern for code signals on the side of the circuit board 18 and is connected to the battery 13 on the other side. This specification does not give the explanation of the power supply from the battery 13 to the code disk 19. With the index 15 aligned with one of the graduations 16, the head portion 11*a* and the base portion 11*b* are held together by bonding or force fit. Thus, the assembly is finished. With this structure, the battery 13 and the code disk 19 are fixed on the side of the inner body 12, and since the head portion 11*a* is integral with the base portion 11*b*, the outer body 11 is slidably held to the inner body 12 through the holder 12*a*. Therefore, when the index 15 on the inner body 12 is set at the setting time graduations 16, the sliding contact 18*a*, which is on the circuit board 18 integral with the outer body 11, slides on the code disk 19 and converts the set time into a code, which is, in turn, stored in the aforementioned data memory circuit 6 of FIG. 3B.

Figure 6:
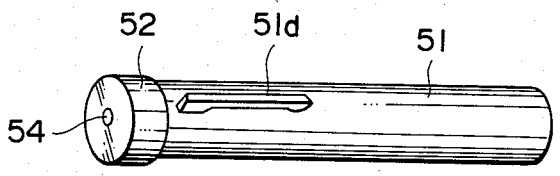
FIG. 6 is an exterior view of a second embodiment of the invention.
Figure 7:
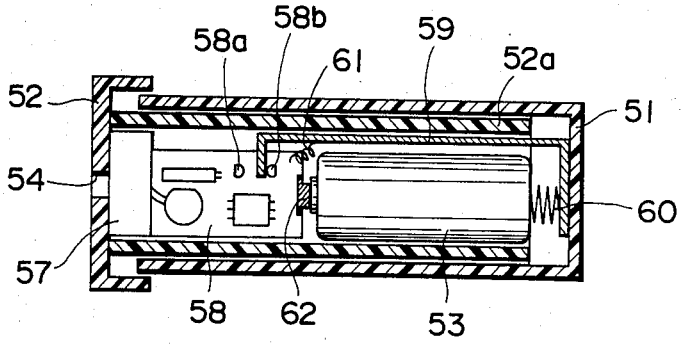
FIG. 7 is a sectional view of FIG. 6.

FIG. 6 is an exterior view of a second embodiment of the invention and FIG. 7 is a sectional view of FIG. 6. This embodiment includes an outer body 51; a clip 51*d*; a cap 52 having a sound emitting hole 54; and an inner body 52*a* which is integral with the cap 52 and accommodates internally a sound emitting means 57, a circuit board 58, a battery 53 and such. A set of switch contacts 58*a* and 58*b* are secured on the circuit board 58 and a conductive member 59 for changing the connection of these contacts 58*a* and 58*b* is fixed on the bottom of the inner surface of the outer body 51. A battery spring 60 usually forces the conductive member 59 to touch the contact 58*b*; however, when the cap 52 is depressed into the outer body 51, the conductive member 59 touches the contact 58*a*. The circuit board 58 is connected to the conductive member 59 by means of a conductor 61 and thus connected to one electrode of the battery 53 by way of the conductor 61, the conductive member 59 and the battery spring 60 and is kept at the same potential as that of the electrode. On the other hand, a conductive part 62 on the circuit board 58 is connected to the other electrode of the battery 53 and is kept at the same potential as that of the electrode.

Figure 8:
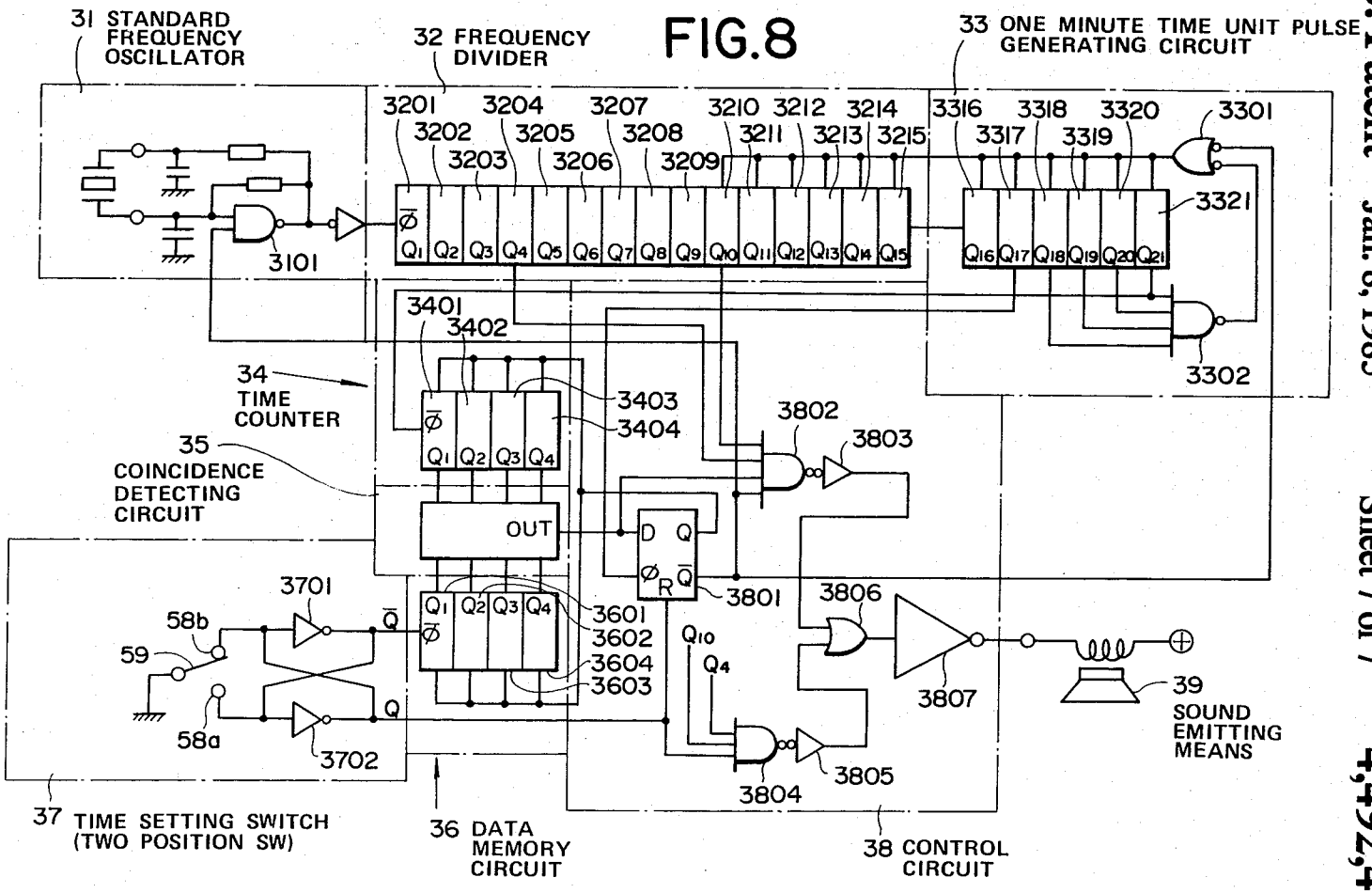
FIG. 8 is a circuit diagram of the second embodiment of the invention.

FIG. 8 is a circuit diagram of the second embodiment of the invention. In this embodiment, the time unit is one minute and the maximum set time is fifteen minutes. This circuit includes a standard frequency oscillator 31; a frequency divider 32; a one minute time unit pulse generating circuit 33; a time counter 34; a time setting switch 37, a data memory circuit 36 for storing an input from the time setting switch 37; a coincidence detecting circuit 35 for comparing the data of the time counter 34 and the data of the data memory circuit 36 and producing a coincidence signal; and a control circuit 38.

The standard frequency oscillator 31 comprises an oscillator and a gate 3101 and sends a reference pulse to the frequency divider 32 only when the gate 3101 turns on. The one minute time unit pulse generating circuit 33 comprises flip-flops 3316 and 3321, a NOR gate 3301 and a NAND gate 3302 and produces a pulse every one minute and sends it to the time counter 34. The time counter 34 comprises binary counters 3401 to 3404 and is countable up to fifteen minutes. The time setting switch 37 comprises a switch section that takes two positions, i.e. a contact 58*b* usually closed and a contact 58*a* usually opened, and a chattering preventing circuit including NOR gates 3701 and 3702. The output $\overline{Q}$ of the NOR gate 3701 is applied to the data memory circuit 36 including binary counters 3601 to 3604, while the output Q of the NOR gate 3702 is applied to the reset terminal R of a data input type flip-flop 3801. The control circuit 38 comprises the data input type flip-flop 3801, an alarm signal composing gate 3802, an amplifier 3803, a time setting tone generator 3804, an amplifier 3805 and such. The data input terminal D of the flip-flop 3801 is connected to the output of the coincidence detecting circuit 35, and the clock input terminal $\phi$ of the flip-flop 3801 is connected to the output $Q_{17}$ of the one minute time unit pulse generating circuit 33. On the other hand, the output Q of the flip-flop 3801 is connected to the reset terminals of the binary counters 3401 to 3404 of the time counter 34 and the reset terminals of the binary counters 3601 to 3604 of the data memory circuit 36, and the output $\overline{Q}$ of the flip-flop 3801 is connected to one of the inputs of the gate 3101 of the standard frequency oscillator 31, one of the inputs of the NOR gate 3301 of the one minute time unit pulse generating circuit 33, and one of the inputs of the alarm signal composing gate 3802, respectively.

As shown in FIGS. 6 and 7, when the cap 52 is depressed into the outer body 51, the conductive member 59 is out of the contact 58*b* and connected to the contact 58*a*. At this moment, as shown in FIG. 8, the binary counters 3601 to 3604 of the data memory circuit 36 count up and simultaneously the data input type flip-flop 3801 is reset. The output $\overline{Q}$ of the flip-flop 3801 goes high, which is applied to the gate 3101. Then, its output is sent to the frequency divider 32 and the one minute time unit pulse generating circuit 33 to operate them. Next, the time counter 34 counts up every one minute, and when the counted value matches the data of the data memory circuit 36 set by the time setting switch 37, the output of the coincidence detecting circuit 35 goes "high". This output is read into the flip-flop 3801 by the rising edge of the output $Q_{17}$ of the intermediate stage 3317 of the one minute time unit pulse generating circuit 33, and the output $\overline{Q}$ of the flip-flop 3801 goes "low". As a result, the gate 3101 is cut off, and the output of the oscillator 31 is not fed to the input of the frequency divider 32. At the same time, the flip-flops 3210 to 3215 of the frequency divider 32 and flip-flops 3316 to 3321 of the one minute time unit pulse generating circuit 33 are reset through the gate 3301. In this manner, after the coincidence detecting circuit 35 produces a coincidence signal, until the output $\overline{Q}$ of the data input type flip-flop 3801 changes to "low", the alarm signal composing gate 3802 sends a signal created by modulating intermittently the signal $Q_4$ of the frequency divider 32 with the output signal $Q_{10}$ thereof and drives the sound emitting means 39 by way of the amplifiers 3803 and 3807. In this embodiment, since $Q_4$ is a 2 kHz signal, $Q_{10}$ is a 32 Hz signal and $Q_{17}$ is a $\frac{1}{4}$ Hz signal, the sound emitting means 39 produces a sound created by modulating intermittently the 2 kHz signal with the 32 kHz signal for two seconds.

As the cap 52 is depressed by an external force into the outer body 51 to make the conductive member 59 into contact with the contact 58*a* (FIGS. 6 and 7), the time setting tone generator 3804 turns on and produces a signal created by modulating intermittently the output signal $Q_4$ of the frequency divider 32 with the output signal $Q_{10}$ thereof and drives the sound emitting means by way of the amplifier 3805, the OR gate 3806 and the amplifier 3807. When the external force is removed, the operation stops. Thus, each depression of the cap 52 is known by an audible tone. That is to say, while confirming the operation of the single switch by tone, the timer can be set for desired time (time period is obtained by multiplying the number of depressions by the time unit). Needless to say, the first embodiment mentioned above can also be designed so that every time the sliding contact 18*a* (FIG. 5) slides one step from OFF position on the code disk 19, a tone will be produced.

While the invention has been described by use of the timer having a time unit of one minute and a maximun set time of 15 minutes with reference to the accompanying drawings, it will be understood that the one minute time unit pulse generating circuit 33 of FIG. 8 may be replaced by a five minute time unit pulse generating circuit to make a five minute time unit timer and that the number of stages of the time counter 34, the data memory circuit 36 and the coincidence detecting circuit 35 may be varied with the capacitance of the setting time.

As will appear from the above detailed description, the timers of the invention have the following features:

(1) Simple circuit and easy setting operation because of one minute or five minute time setting unit which is suitable for ordinary life.

(2) Enhanced operability because the set time is known visually or audibly.

(3) Avoiding a failure of catching the alarm because the sound emitting means is located at the top portion of the body.

(4) Realized new types of timers such as a pendant and a brooch type because the small inner structure permits the design variation of the outer shape.

(5) More convenience in use when combined with a writing or drawing instrument.

What is claimed is:

1. A small electronic timer comprising:
(1) a circuit arrangement including;
(a) a standard frequency oscillator,
(b) a frequency divider,
(c) a time unit pulse generating circuit for generating a time unit pulse in response to an output signal of said frequency divider,
(d) a time counter for counting said time unit pulse,
(e) a data memory circuit,
(f) a coincidence detecting circuit for comparing data stored in said data memory circuit and data of said time counter and producing a coincidence signal, and
(g) a control circuit operated by said coincidence signal,
(2) a battery for supplying power to said circuit arrangement;
(3) a sound emitting means driven by said control circuit;
(4) a time setting means for feeding a set time to said data memory circuit; and
(5) a first housing and a second housing for accommodating said circuit arrangement, battery, sound emitting means and time setting means, said first and second housings permitting their relative position to be changed;
(6) whereby, by changing the relative position of said first and second housings, said time setting means is operated and said timer is set.

2. A small electronic timer of claim 1 wherein said time setting means includes a code disk for reading the set time as a coded signal, and a sliding contact, said code disk being fixed at one of said first and second housings or a member integral with it, and said sliding contact being fixed at the other of said first and second housings or a member integral with it, whereby, by changing the relative position of said first and second housings, said timer is set.

3. A small electronic timer of claim 1 wherein said time setting means includes a two position switch, one of said first and second housings or a member integral with it has a set of contacts, and the other of said first and second housings or a member integral with it has a common contact, whereby, by changing axially the relative position of said first and second housings, said timer is set.

4. A small electronic timer of claim 1 wherein one of said first and second housings forms a sound emitting hole in its one end, and said sound emitting means is held in the vicinity of said hole.

5. A small electronic timer of claim 1 wherein said circuit arrangement further comprises a circuit for driving said sound emitting means during the operation of said time setting means and for permitting the data stored in said data memory circuit to be known audibly.

6. A small electronic timer of claim 1 wherein said time unit pulse generating circuit generates a pulse every one minute or every five minutes.

7. A small electronic timer of claim 2 wherein said code disk comprises a gray code.

8. A small electronic timer of claim 2 wherein one of said first and second housings is provided with an index on its outside surface, and the other is provided with setting graduations on its outside surface.

9. A small electronic timer comprising:
(1) a circuit arrangement including;
(a) a standard frequency oscillator,
(b) a frequency divider,
(c) a time unit pulse generating circuit for generating a time unit pulse in response to an output signal of said frequency divider,
(d) a time counter for counting said time unit pulse,
(e) a data memory circuit,
(f) a coincidence detecting circuit for comparing data stored in said data memory circuit and data of said time counter and producing a coincidence signal, and
(g) a control circuit operated by said coincidence signal,
(2) a battery for supplying power to said circuit arrangement;
(3) a sound emitting means driven by said control circuit;
(4) a time setting means for feeding a set time to said data memory circuit; and
(5) a first housing and a second housing for accommodating said circuit arrangement, battery, sound emitting means and time setting means, said first and second housings permitting the relative position to be changed;
(6) said time setting means including a code disk for reading the set time as a coded signal, and a sliding contact, said code disk being fixed at one of said first and second housings or a member integral with it, said sliding contact being fixed at the other of said first and second housings or a member integral with it, one of said first and second housings being provided with an index on its outside surface, and the other being provided with setting graduations on its outside surface,
(7) whereby, by changing the relative position of said first and second housings, said time setting means is operated and said timer is set.

10. A small electronic timer comprising:
(1) a circuit arrangement including;
(a) a standard frequency oscillator,
(b) a frequency divider,
(c) a time unit pulse generating circuit for generating a time unit pulse in response to an output signal of said frequency divider,
(d) a time counter for counting said time unit pulse,
(e) a data memory circuit,
(f) a coincidence detecting circuit for comparing data stored in said data memory circuit and data of said time counter and producing a coincidence signal, and
(g) a control circuit operated by said coincidence signal,
(2) a battery for supplying power to said circuit arrangement;

(3) a sound emitting means driven by said control circuit;

(4) a time setting means for feeding a set time to said data memory circuit; and (5) a first housing and a second housing for accommodating said circuit arrangement, battery, sound emitting means and time setting means, said first and second housings permitting the relative position to be changed;

(6) said time setting means comprising a two position switch, one of said first and second housings or a member integral with it having a set of contacts, and the other of said first and second housings or a member integral with it having a common contact, and said circuit arrangement further comprising a circuit for driving said sound emitting means during the operation of said time setting means and permitting the data stored in said data memory circuit to be known audibly, (7) whereby, by moving axially the relative position of said first and second housings, said timer is set while an audible tone is given.

* * * * *